US006067952A

United States Patent [19]

Andrasko et al.

[11] Patent Number: 6,067,952

[45] Date of Patent: May 30, 2000

[54] CYLINDER BORE LUBRICATION WITH RESIDUAL OIL

[75] Inventors: Neil M. Andrasko, Oshkosh; Kenneth G. Appleby, Van Dyne; David W. Kusche; Steven W. Habeck, both of Oshkosh, all of Wis.

[73] Assignee: Brunswick Corporation, Lake Forest, Ill.

[21] Appl. No.: 09/209,512

[22] Filed: Dec. 10, 1998

[51] Int. Cl.[7] ..... F01M 1/00

[52] U.S. Cl. ..... 123/196 R; 123/196 CP; 123/196 W; 184/6.8

[58] Field of Search ..... 123/196 R, 196 W, 123/196 CP; 184/6.5, 6.8, 6.18

[56] References Cited

U.S. PATENT DOCUMENTS

| | | | |
|---|---|---|---|
| 4,672,931 | 6/1987 | Biagini | 123/193 |
| 4,794,896 | 1/1989 | Tsai et al. | 123/193 |
| 4,820,213 | 4/1989 | Holtermann et al. | 440/88 |
| 4,926,814 | 5/1990 | Bonde | 123/196 |
| 4,945,864 | 8/1990 | Solomon et al. | 123/41.39 |
| 4,993,380 | 2/1991 | Hsu | 123/193 |
| 5,115,791 | 5/1992 | Dore | 123/572 |
| 5,396,867 | 3/1995 | Ito et al. | 123/41.39 |
| 5,511,523 | 4/1996 | Masuda | 123/196 R |
| 5,513,608 | 5/1996 | Takashima et al. | 123/196 W |
| 5,617,822 | 4/1997 | Masuda | 123/196 R |
| 5,694,891 | 12/1997 | Liebich | 123/68 |
| 5,709,186 | 1/1998 | Taue | 123/196 W |
| 5,964,198 | 10/1999 | Wu | 123/196 R |
| 5,975,042 | 11/1999 | Aizawa et al. | 123/196 M |

*Primary Examiner*—Noah P. Kamen
*Assistant Examiner*—Hai Huynh
*Attorney, Agent, or Firm*—William D. Lanyi

[57] ABSTRACT

A lubrication system for an internal combustion engine provides drain openings at locations within individual crankcase portions where residual oil collects during normal operation. The drain openings are connected to orifices formed through cylinder walls of other crankcase portions of the engine. Conduits connect preselected drain openings to associated orifice check valves to pump the residual oil from the collecting regions to the cylinder walls of other crankcase portions using differential pressures that occur naturally between the associated crankcase portions. The drain openings located at the collecting regions can be located directly under primary oil entry points of the crankcase portions, but this relationship is not absolutely necessary as long as the drain openings are placed at the collecting regions or, alternatively stated, as long as the drain openings are placed at locations where oil will tend to flow from the points of primary oil entry into the crankcase portions.

20 Claims, 6 Drawing Sheets

CYLINDER BORE LUBRICATION WITH RESIDUAL OIL

BACKGROUND OF THE INVENTION

1. Field of the Invention

The present invention is generally related to a lubrication system for an internal combustion engine and, more particularly, to a lubrication system that conducts residual oil from a crankcase of a two cycle engine to a cylinder bore of the engine.

2. Description of the Prior Art

Internal combustion engines require lubrication to prevent damage to engine components which move in a sliding relationship with other engine components. Certain types of internal combustion engines, such as some two cycle engines, provide oil in a mixture of fuel so that the oil is carried through the crankcase of the engine to lubricate the crankcase, connecting rods, and piston of each cylinder. Some engines inject oil directly into the crankcase at a position where incoming air flow will carry the oil throughout the crankcase and lubricate the moving components of the engine.

When an internal combustion engine is operating at a sufficiently high speed, the flow of air through the crankcase will generally be sufficient to distribute the oil, as a mist, to all portions of the crankcase. However, under certain conditions, residual oil can collect in puddles within the crankcase. If sufficient air flow is not available to distribute the oil, as a mist, throughout all regions of the crankcase, two significant problems can occur. First, certain portions of the pistons and connecting rods can be deprived of sufficient lubrication to prevent damaging wear and excessive heat caused by friction. In addition, the residual oil that collects in puddles within the crankcase will eventually be drawn from the crankcase and into the combustion chambers of the engine. This excessive oil can severely affect the operating quality of the engine and foul the spark plugs. It is generally known to those skilled in the art that residual oil can be conducted from the puddles in the crankcase to the combustion chamber where it is burned so that excessive accumulation of residual oil in the crankcase does not occur.

Another problem that can occur in internal combustion engines is the insufficiency of lubrication on the cylinder walls to prevent excessive wear and heat buildup from friction as the piston moves reciprocally within the cylinder. Under proper conditions, oil which is introduced at the air intake of a crankcase will be carried by the air, as a mist, into contact with the cylinder wall below the piston and the other moving components such as the connecting rods and crankshaft. However, if the airflow through the crankcase is insufficient to carry the oil mist into contact with these portions of the engine, the cylinder wall may not receive sufficient lubrication to prevent wear and excessive heat buildup resulting from the friction between the moving pistons and the stationary cylinder walls. This condition, where insufficient oil is carried by the air into contact with the moving components of the engine, is most likely to occur when the engine is operating at relatively low speeds such as when the engine is idling. Many different methods have been used by those skilled in the art to address the issues of residual oil removal from the crankcase and lubrication of the cylinder walls of an internal combustion engine.

U.S. Pat. No. 4,945,846, which issued to Solomon et al on Aug. 7, 1990, describes a two cycle engine piston lubrication. A two cycle engine has oil distribution means through the cylinder wall to feed internal oil passages in the associated piston that distribute oil directly to the skirt and cylinder walls. The oil is preferably fed between ports and/or to the wrist pin and connecting rod bearing to thereby limit oil carryover into the engine charging and scavenging air.

U.S. Pat. No. 5,115,791, which issued to Dore on May 26, 1992, discloses an engine crankcase with crankcase gas exhaust and oil recirculation systems. The device relates to a crankcase or cylinder block for an internal combustion engine of any type, for example, of the V or in-line cylinder type. The upper half of the crankcase comprises internal conduits which connect the upper part of the crankcase with the lower compartments separating the crankcase bearings, these conduits making possible the exhaust of crankcase gases and the recycling of the engine oil and opening into a chamber of a flat shape, with the chamber and the internal conduits forming an integral as-cast system. The system is particularly applicable to the automotive industry.

U.S. Pat. No. 4,672,931, which issued to Biagini on Jun. 16, 1987, describes a lubrication system with oil recovery for a two-stroke engine piston with pump-sump for scavenging. The lubrication system has an oil recovery capability for a two-stroke engine piston with pump-sump for scavenging. The system consists of a lubricating oil pressure circulation system having inlet and outlet holes for the oil. The holes pass through the wall of the cylinder. The system also comprises shaped scraper rings, wherein each ring is housed within a circular housing or seat obtained on the outside skirt of the piston. The circular housings are provided on the skirt of the pistons at a height which does not allow any overlapping of the scraper rings on the transfer ports of the two-stroke engine.

U.S. Pat. No. 4,926,814, which issued to Bonde on May 22, 1990, discloses a crankcase breather and lubrication oil system for an internal combustion engine. The engine has a vertically oriented crankshaft and a horizontally oriented cylinder bore and includes a plurality of lubrication sites to be pressure lubricated. A first upstanding wall extends upwardly from the top wall of the crankcase and circumscribes and defines a first chamber. A breather passage communicates crankcase gases from the crankcase into the first chamber. A drain passage communicates oil separated from the crankcase gases in the first chamber into the cylinder bore below the piston and its positioned along the cylinder bore so as to be periodically occluded by the piston during reciprocation thereof. A second upstanding wall extends upwardly from the top wall of the crankcase in spaced relationship to at least a portion of the first wall, and defined together with the first wall a second chamber therebetween. A first oil passage communicates oil from the a lubricant pump to the second chamber, and a second oil passage communicates from the second chamber to at least one of the lubrication sites.

U.S. Pat. No. 4,993,380, which issued to Hsu on Feb. 19, 1991, discloses a lubrication mechanism of an engine cylinder. The mechanism includes upper and lower ring troughs on the inside wall of the engine cylinder. The two ring troughs can accommodate oil pipes and ring oil nets. The oil pipes include an inlet pipe and an outlet pipe. Channels and numerous oil pores are defined by the pipes to allow the entrance of lubricating oil into the oil pipes and seepage from the pores on the oil pipe through a ring oil net to provide lubrication to the inside wall of the cylinder. The lubricating oil then flows downwardly to the lower ring oil net, through the net and the oil pipe, and into an outlet pipe for discharge.

The patents described immediately above are hereby explicitly incorporated by reference in the following description.

In view of the above discussion, it can be seen that it would be significantly beneficial if a simple and cost effective means could be provided to collect residual oil in the crankcase of an internal combustion engine and conduct that oil directly to the bores of cylinders within the engine.

SUMMARY OF THE INVENTION

A lubrication system for an internal combustion engine made in accordance with the present invention comprises a first piston disposed within a first cylinder of an engine for reciprocating movement therein. The first piston is connected by a first connecting rod to a crankshaft of the engine and the first connecting rod is located within a first crankcase portion of the engine. The first crankcase portion of the engine has a collecting region where residual oil can collect during operation of the engine. A preferred embodiment of the present invention further comprises a drain opening formed through a housing of the first crankcase portion in fluid communication with the collecting region.

A lubrication system for the engine further comprises a second piston disposed within a second cylinder of the engine for reciprocating movement therein. The second piston is connected by a second connecting rod to the crankshaft of the engine. The second connecting rod is located within a second crankcase portion of the engine and the second cylinder has an orifice formed through an internal cylindrical wall of the second cylinder. In addition, the present invention comprises a conduit which is connected between the drain opening and the orifice in order to conduct the residual oil from the collecting region to the orifice.

In a particularly preferred embodiment of the present invention, a check valve is disposed in serial fluid communication with the conduit in order to inhibit fluid flow in a direction from the orifice to the drain opening. This check valve encourages the fluctuating pressures in the respective crankshaft portions of the engine to cause residual oil to flow in a preferred direction from the drain opening to the orifice.

A preferred embodiment of the present invention further comprises an oil inlet which is formed through the housing of the first crankcase portion and an oil pump which is connected in fluid communication with the oil inlet to pump oil into the first crankcase portion through the oil inlet. The lubrication system further comprises a reed valve assembly disposed within the first crankcase portion to permit air to flow into the first crankcase portion.

The oil inlet can be disposed directly above the drain opening within the first crankcase portion. More particularly, a preferred embodiment of the present invention disposes the oil inlet at a location which is upstream of a fluid path to the drain opening along which oil tends to flow during certain normal modes of operation of the engine.

In a particularly preferred embodiment of the present invention, the first and second pistons are 180° out of phase with each other with the first piston being at its top dead center (TDC) position when the second piston is at its bottom dead center (BDC) position. The orifice can be formed through an internal cylindrical wall of the second cylinder at a position below the piston rings of the second piston when the second piston is at its bottom dead center (BDC) position. The drain opening and the orifice are on a common side of the engine in a particularly preferred embodiment of the present invention. The engine can be a six cylinder engine with the six cylinders being arranged in two rows of three cylinders each. The first and second cylinders are disposed in a common row with each other.

BRIEF DESCRIPTION OF THE DRAWINGS

The present invention will be more fully and completely understood from a reading of the description of the preferred embodiment in conjunction with the drawings in which.

DESCRIPTION OF THE PREFERRED EMBODIMENT

Figure 1:
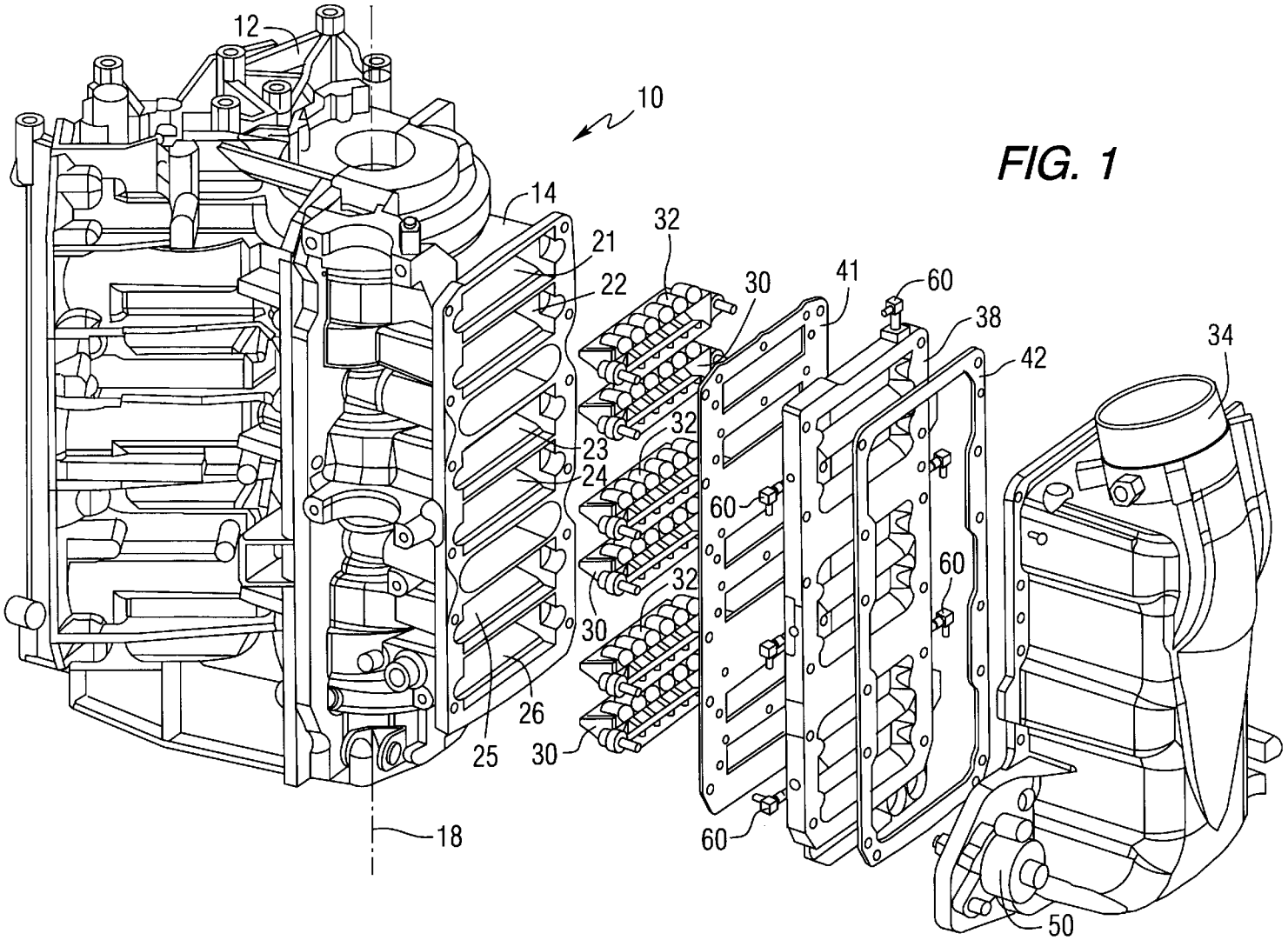
FIG. 1 is an exploded isometric view of an engine.

Throughout the description of the preferred embodiment of the present invention, like components will be identified by like reference numerals.

FIG. 1 shows an isometric exploded view of a two cycle internal combustion engine. An engine block assembly 10 comprises the engine block 12 and a crankcase 14. The engine illustrated in FIG. 1 is a V-six two stroke engine. The crankcase 14 is separable from the block 12 to allow assembly of the crankshaft within the opening aligned with centerline 18. The crankcase 14 has six crankcase portions identified by reference numerals 21–26.

A plurality of reed blocks 30 each comprise a plurality of reed valves 32 which allow a one way flow of air, from right to left in FIG. 1, into their respective crankcase portions from an air plenum 34. The reed blocks 30 are held in place and supported by a reed block adapter plate 38. Two gaskets, 41 and 42, are located on opposite surfaces of the reed block adapter plate 38. Each of the reed blocks 30 is attached to the reed block adapter plate 38 by screws. After the reed blocks 30 are located within their respective crankcase portions, 21–26, and maintained in place by the reed block adapter plate 38, the air plenum 34 is attached to the crankcase 14.

With continued reference to FIG. 1, oil is pumped by an oil pump 50 to the plurality of oil injection check valves 60. The oil is conducted from the oil pump 50 to each of the oil injection check valves 60 by individual conduits, such as rubber tubing. Internal passages (not shown in FIG. 1) formed within the reed block adapter plate 38 conduct the oil to specific locations on the surface of the reed block adapter plate 38 most proximate to the reed blocks 30. Each of the oil injection check valves 60 conducts oil from the pump 50 to a particular location above its respective reed block 30. The oil is then distributed by the air flow passing from the air plenum 34 through the reed valves 32 into the associated crankcase portions 21–26.

The oil injection check valves 60 can be spring loaded to provide a resistance to the flow of oil of approximately 5 to 7 psi to the direction of flow from the pump 50 toward the crankcase portions 21–26. Flow in the opposite is prevented by the check valves.

Figure 2:
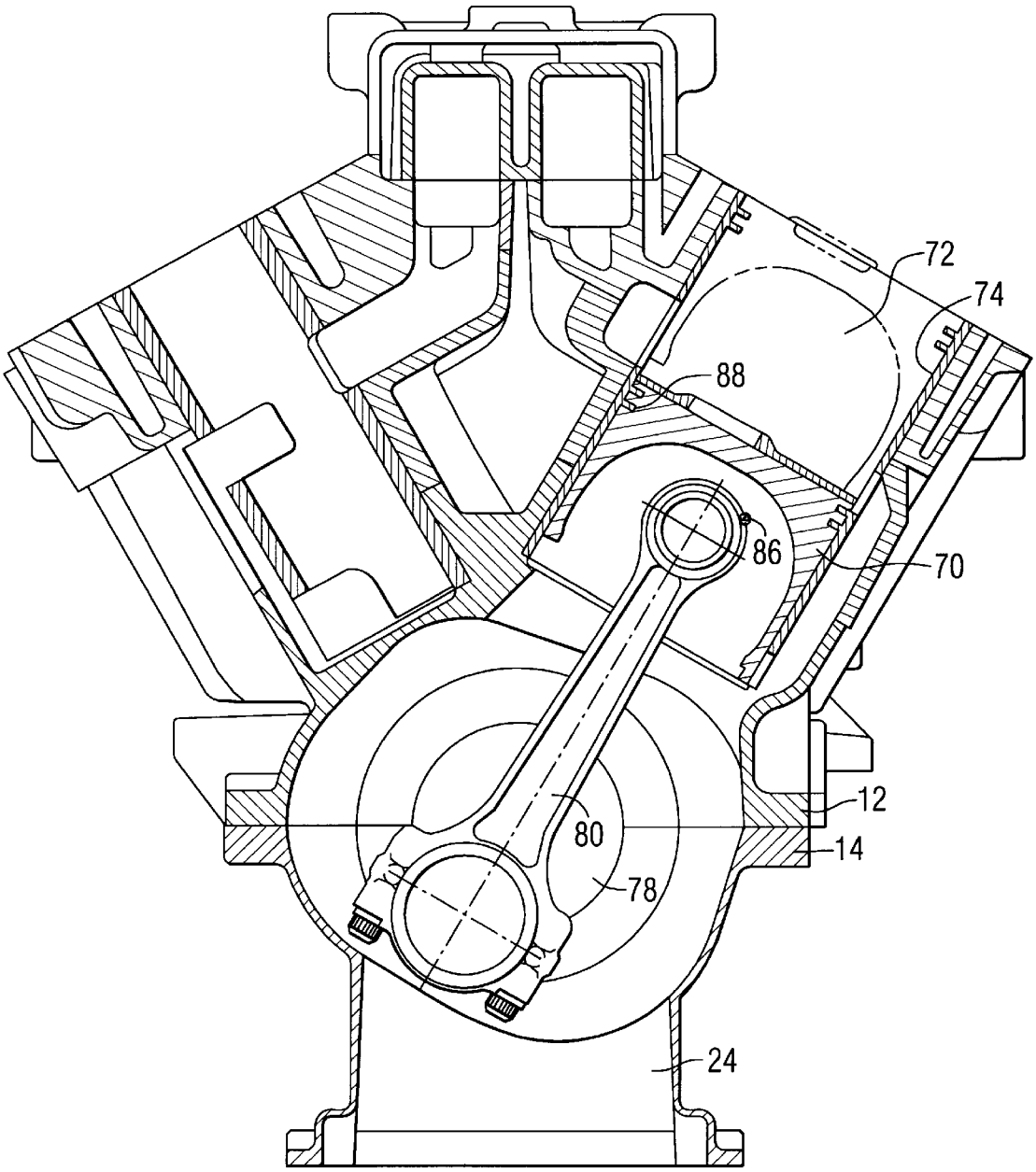
FIG. 2 is a section view of one cylinder and crankcase of the engine shown in FIG. 1.

FIG. 2 is a sectional view of one crankcase portion 24. In FIG. 2, a piston 70 is disposed within a cylinder 72 for reciprocal movement therein. A cylinder liner 74 is provided in the cylinder 72 in order to improve the surface characteristics of the cylinder wall. The piston 70 is connected to a crankshaft 78 by a connecting rod 80. Rotation of the crankshaft 78 about centerline 18, described above in conjunction with FIG. 1, causes the piston 70 to move from a bottom dead center (BDC) position shown in FIG. 2 by solid lines to a top dead center (TDC) position shown in FIG. 2 by dashed lines.

In FIG. 2, a black dot 86 identifies the approximate location of an orifice which will be described below in greater detail. The orifice is provided so that a flow of residual oil can be conducted into the cylinder 72 at the cylinder wall. It can be seen in FIG. 2 that the location of the orifice, identified by black dot 86, is below the piston rings 88 when the piston 70 is at its bottom dead center position.

Because the engine 10 is intended for use in an outboard motor application, centerline 18 is vertical and the reciprocating motion of the piston 70 is generally horizontal. Notwithstanding these physical characteristics, normal terminology refers to the bottom dead center (BDC) position of the piston 70 as being the position where the piston 70 is closest to the centerline 18 of the crankshaft 78. Conversely, the top dead center (TDC) position of the piston 70 is the location where the piston is the farthest from the centerline 18 of the crankshaft 78. That standard terminology will be used throughout the description of the preferred embodiment. Similarly, when the location of the orifice 86 is described as being below the piston rings 88 when the piston 70 is at its bottom dead center (BDC) position, this refers to the orifice 86 being closer to the centerline 18 of the crankshaft 78 than the piston rings 88 under these conditions. Most importantly, the piston rings 88 do not move past the orifice 86 as they travel from the top dead center (TDC) position shown by dashed lines in FIG. 2 to the bottom dead center (BDC) position shown by solid lines in FIG. 2.

Figure 3:
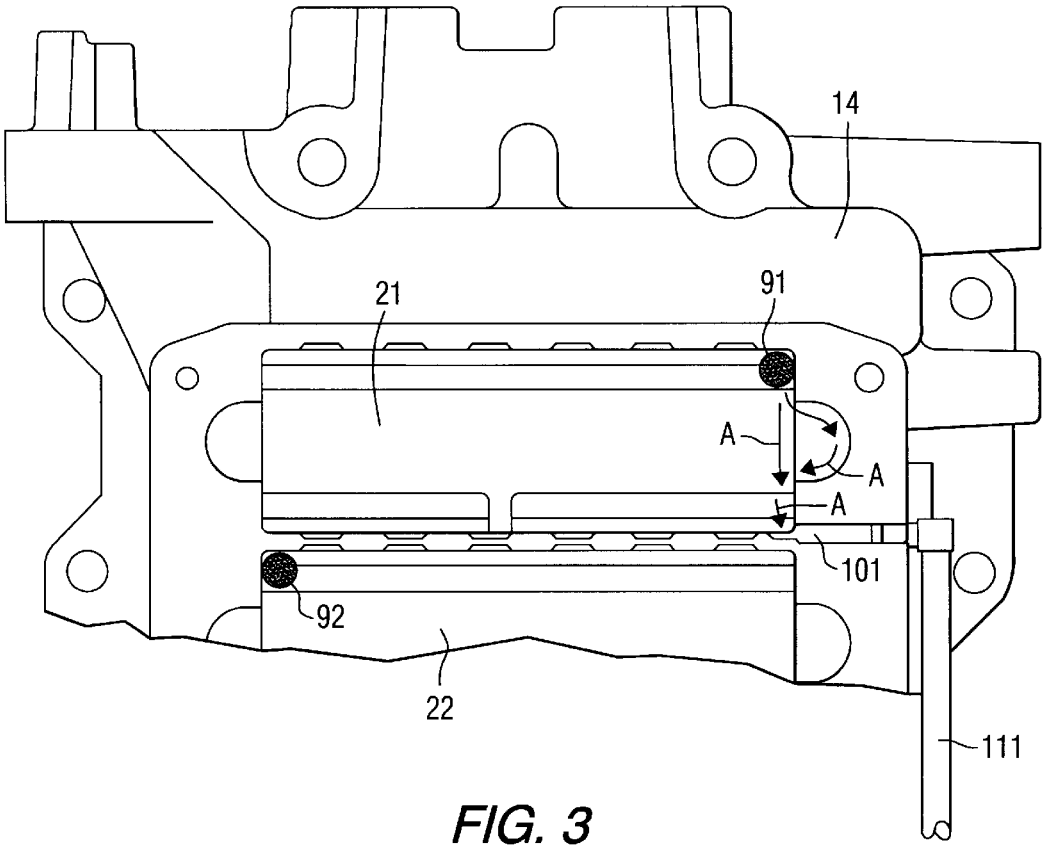
FIG. 3 is a partial view of a single crankcase portion, its primary oil entry point, and its drain opening.

FIG. 3 is a view of one crankcase portion 21 of the engine 10 described above in conjunction with FIG. 1. Black dot 91 in FIG. 3 identifies a location where oil is deposited after passing through the reed block adapter plate 38. The oil is pumped by the pump 50, through a flexible conduit, to the uppermost oil injection check valve 60 in FIG. 1. An internal passage formed in the reed block adapter plate 38 directs that flow of oil through a surface of the reed block adapter plate most proximate the reed block 30. Black dot 91 in FIG. 3 identifies the location where that oil communicates with the crankcase portion 21 above the uppermost reed block 30 in FIG. 1. It should be understood that black dot 91 in FIG. 3 is intended to identify a location above the reed block and within the crankcase portion, but does not represent an actual physical structure in FIG. 3. Black dot 92 in FIG. 3 represents a similar location for the crankcase portion 22 which is directly below the crankcase portion 21.

With continued reference to FIG. 3, it should be understood that under operating conditions that cause a significant air flow through the air plenum 34 and the reed blocks 30, the oil deposited at the location of black dot 91 is immediately carried by the rapidly flowing air into the crankcase portion downstream from the reed block 30. This oil is transported by the air stream, as a mist, to the various components shown in FIG. 2. This oil mist provides adequate lubrication for the piston 70, the connecting rod 80, the crankshaft 78 and all of their surfaces which are disposed in sliding relationship with other surfaces. Some of the oil mist is carried through the intake port of the associated cylinder and is burned in the combustion chamber of that cylinder. However, under certain operating conditions, the air flow from the air plenum 34 through the reed blocks 30 is not sufficient to carry the oil from the primary oil entry point 91 to the various surfaces that require lubrication. For example, when the engine 10 is running at low speed, such as when it is idling, the air flow is insufficient to properly carry the lubricant to the sliding surfaces within the crankcase. When this occurs, oil pumped by the oil pump 50 to the primary oil entry point 91 can flow under the influence of gravity along internal surfaces of the crankcase portion into which it was injected. When this occurs, residual oil can form puddles within the crankcase portion. Two significantly deleterious conditions can arise from this phenomenon. First, the oil injected at the primary oil entry point 91 is not carried to the locations where it is needed to provide proper lubrication. This is particularly serious with regard to the internal cylindrical surfaces of the cylinders where the outer cylindrical surfaces of the pistons move in sliding contact and can cause both wear and excessive heat due to friction between these surfaces. A second problem caused by the puddling of residual oil is the eventual flow of the residual oil from the puddles at various collecting regions of the crankcase portions to the combustion chamber of an associated cylinder. If a large quantity of residual oil is carried to the combustion chamber, such as when the engine is again operated at high speed the excessive amount of oil in the combustion chamber can adversely affect the operating characteristics of the engine and foul the spark plug of that cylinder.

In FIG. 3, arrows A identify a probable path for oil to flow from the primary oil entry point 91 under the influence of gravity when the air flow through the reed blocks is not sufficient to carry the oil away from the reed blocks 30 as a mist. Eventually, the oil collects at a collecting region of the crankcase portion 21. In FIG. 3, the collecting region for crankcase portion 21 is at its bottom portion toward the right of the crankcase portion in FIG. 3. Oil can be expected to puddle along the bottom surface of the first crankcase portion 21 below the reed block 30 for that crankcase portion.

With continued reference to FIG. 3, the present invention provides a drain opening 101 at the collecting region of the crankcase portion. The conduit 111 is connected to the drain opening 101 to carry the oil away from the collecting region of the first crankcase portion 21.

Figure 4:
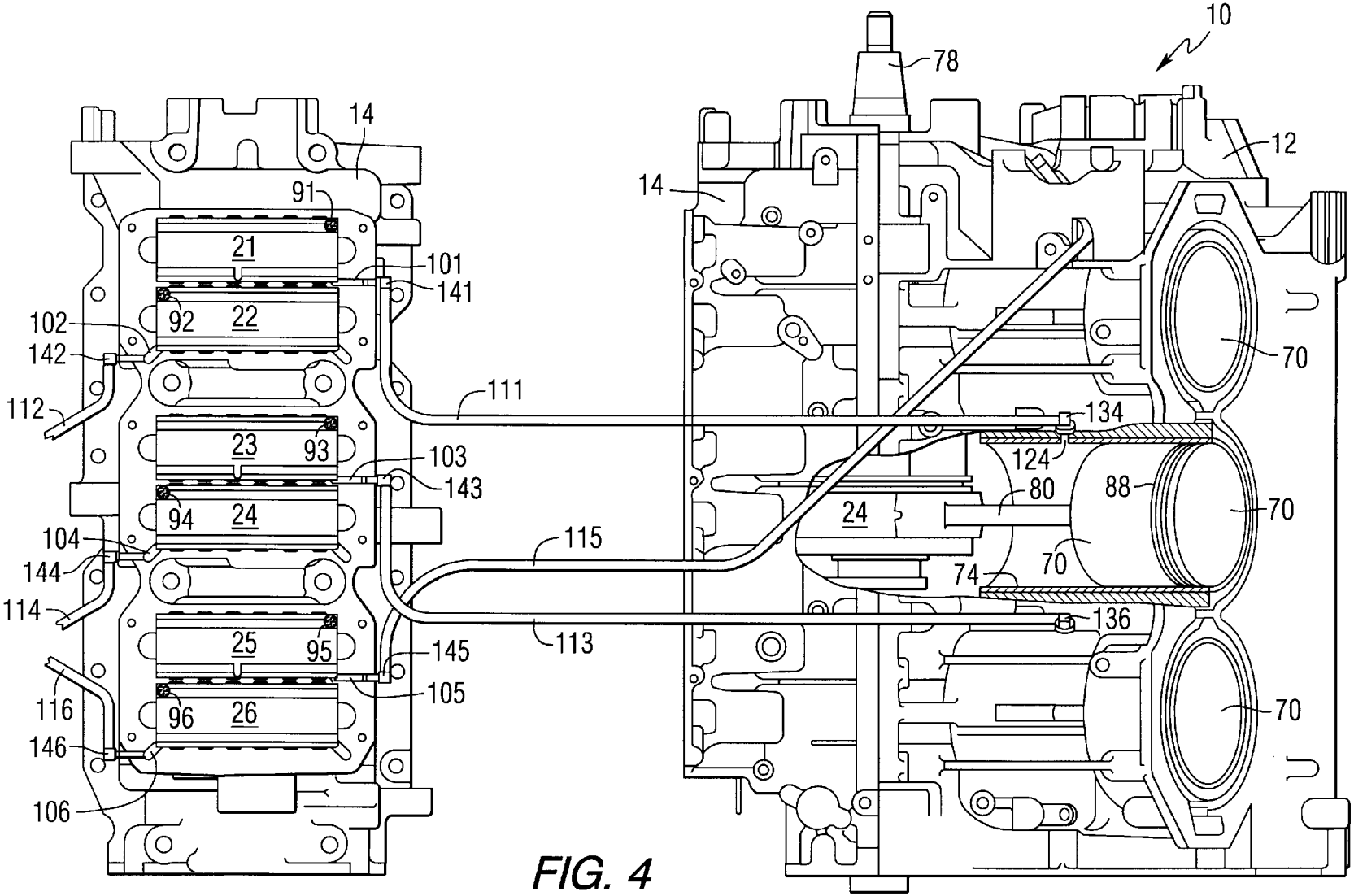
FIG. 4 combines two side views of an engine to show the relative positions of the crankcase portions, primary oil entry points, drain openings, conduits, check valves, and orifices through which oil is provided to associated cylinder walls.

FIG. 4 shows two side views of the engine 10, side-by-side, for the purpose of describing the various interconnections and fluid flows of the present invention. The six crankcase portions, 21–26, are identified in the left portion of FIG. 4. The illustration at the right portion of FIG. 4 shows one side of the two cycle engine 10 which is a V-six engine. The central crankcase portion 24 and its cylinder on the right portion of FIG. 4 is sectioned to allow further description of the present invention and to illustrate the relative positions of the components within the crankcase portion 24. The orifice identified by reference numeral 86 in FIG. 2 is shown in the section portion of the right side of FIG. 4 and identified by reference numeral 124. A ball check valve 134 is connected in serial fluid communication with the conduit 111 that is connected between the drain opening 101 and the orifice 124. The standard fitting 141 is used to connect the conduit 111 to the drain opening 101. Each cylinder of the engine is provided with an orifice similar to the one identified by reference numeral 124 in FIG. 4. Furthermore, each crankcase portion, 21–26, is provided with an associated drain opening 101–106 and each drain opening is provided with an associated fitting 141–146 that allows it to be connected in fluid communication with an associated conduit 111–116. Each of these conduits 111–116 is connected to a check valve such as those identified by reference numerals 134 and 136 in FIG. 4. Other similarly constructed check valves are provided but not shown in FIG.

4. These check valves, such as those identified by reference numerals 134 and 136 in FIG. 4, serve the purpose of inhibiting reverse flow through the conduits 111–116, such as from the orifice 124 back to the drain opening 101. Therefore, as a result of the check valves, such as those identified by reference numerals 134 and 136, the flow of oil through the conduits always flows in a direction from a drain opening to an associated orifice.

With continued reference to FIG. 4, it can be seen that each of the conduits 111–116 connects the drain opening of one crankcase portion to a cylinder wall of a cylinder associated with a different crankcase portion. For example, drain opening 101 of crankcase portion 21 is connected by conduit 111 to orifice 124 of the piston 70 associated with crankcase portion 24. These interconnections between different crankcase portions allows the present invention to use differential crankcase pressures to pump the residual oil from a drain opening of one crankcase portion to an associated orifice of another crankcase portion in cooperation with an associated check valve. For example, the drain opening 101 of the first crankcase portion 21 is connected with the orifice 124 associated with crankcase portion 24. Because of this connection, residual oil from the first crankcase portion is pumped to the cylinder of the fourth crankcase portion. In a similar manner, residual oil from the second, third, fourth, fifth, and sixth crankcase portions drains to the orifices in the cylinder walls associated with the fifth, sixth, first, second, and third crankcase portions. These particular associations between drain openings and orifices are selected because they provide the maximum differential pressure between the associated crankcase portions during operation of the engine. This, in turn, creates the maximum pumping force in association with the check valves, such as those identified by reference numerals 134 and 136 in FIG. 4.

Figure 5:
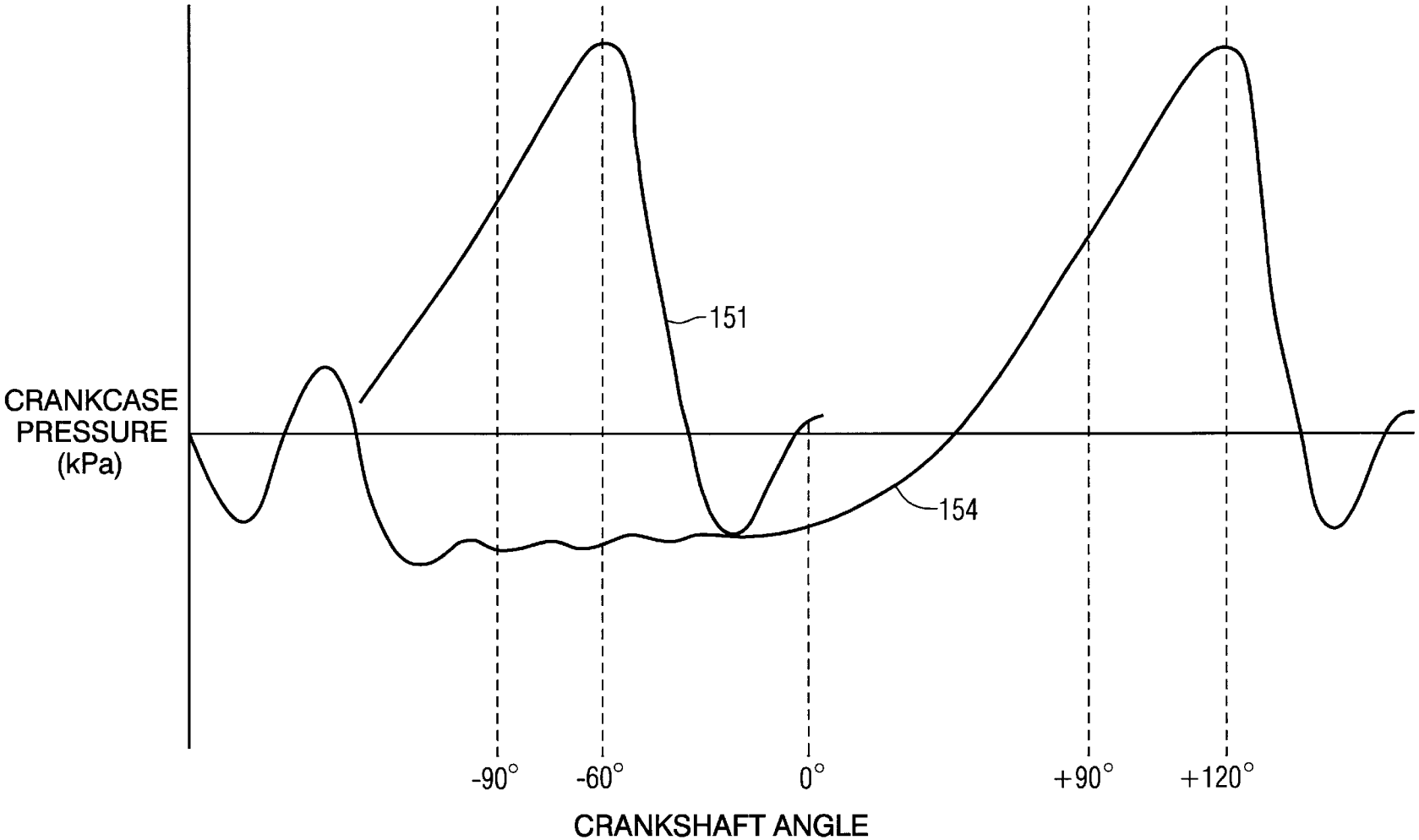
FIG. 5 is a graphical representation of two crankcase portion pressure profiles which are 180° apart in crank angle.

FIG. 5 shows the crankcase pressures of the first and fourth crankcase portions, 21 and 24, of the engine 10. Line 154 in FIG. 5 represents the pressure profile for the fourth crankcase portion 24 and line 151 represents the pressure profile of the first crankcase portion 21. Only a portion of line 151 is shown in FIG. 5 because the pumping action is only provided when the pressure in the first crankcase portion 21 is greater than the pressure in the fourth crankcase portion 24. During other times, the check valve 134 prevents reverse flow through conduit 111. As can be seen, the two pressure profiles in FIG. 5 reach their maximum magnitudes at crankshaft angles that are 180° apart. As a result, the pressure in the first crankcase portion reaches a maximum when the pressure in the fourth crankcase portion is at or near its minimum pressure. This results in excellent pumping action through conduit 111 in combination with the check valve 134.

With reference to FIG. 4, it can be seen that the drain openings for the six crankcase portions 21–26 are arranged on alternating sides of the crankcase. This arrangement places the drain openings for the first, third, and fifth crankcase portions on the same side of the engine 10 as the orifices for the second, fourth, and sixth crankcase portions. In addition, the drain openings for the second, fourth, and sixth crankcase portions are placed on the same side of the engine 10 as the orifices for the first, third, and fifth crankcase portions. There is a significant benefit from this arrangement. As described above in conjunction with FIG. 5, the most preferred interconnections between drain openings and orifices are those which provide the situation shown in FIG. 5 to maximize the pressure differentials and the pumping actions through the conduits. However, this arrangement of placing the drain openings on the same side of the engine as the preferred orifice locations has an additional benefit. If the conduits, 111–116, shown in FIG. 4 are inadvertently disconnected and reconnected to inappropriate orifices, the system will still work satisfactorily because the other two orifices on the same side of the engine as the drain opening will still provide a pressure differential which is sufficient to pump oil through the conduit. This concept is graphically illustrated in FIG. 6.

Figure 6:
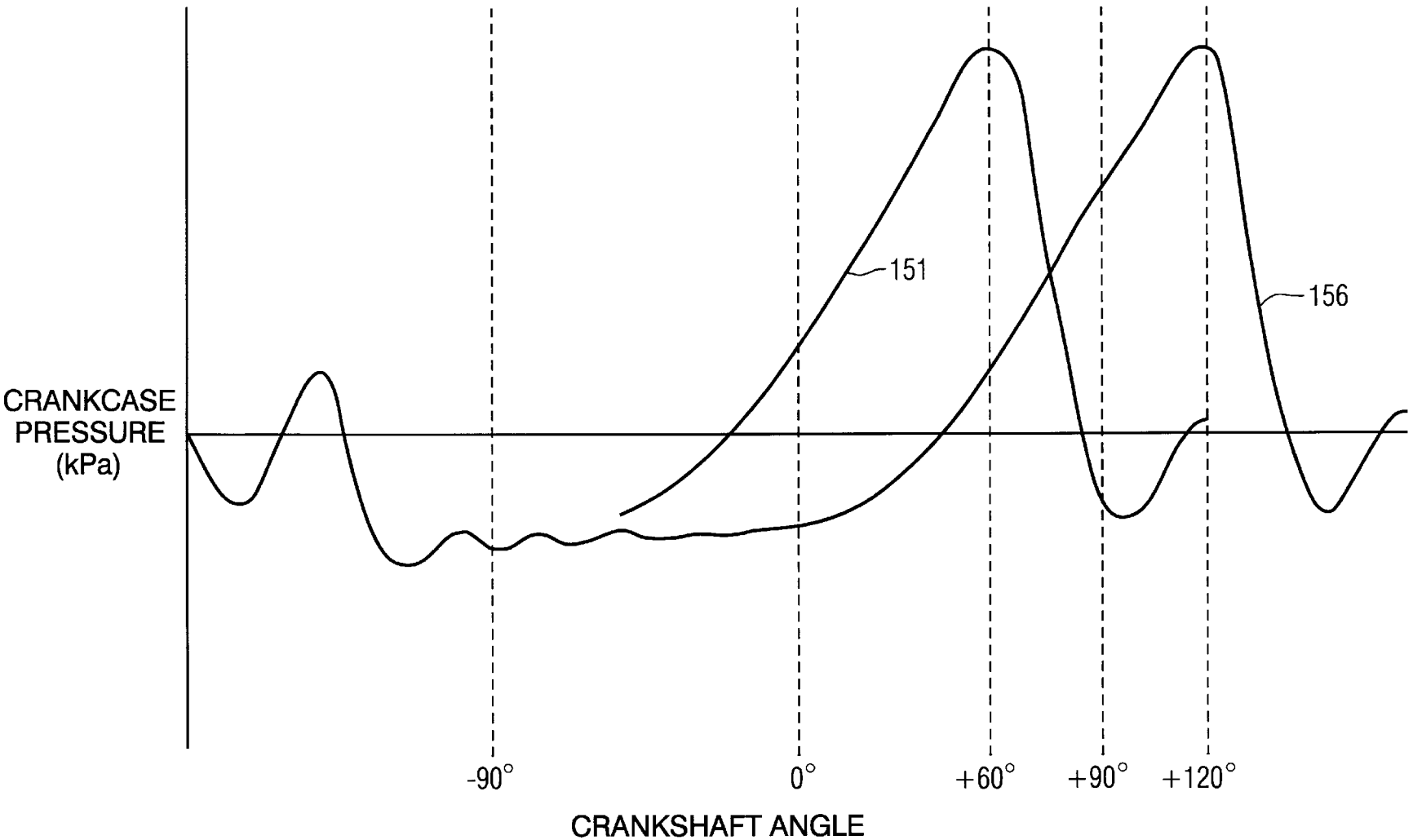
FIG. 6 is a graphical representation of two pressure profiles for crankcase portions which are only 60° apart in crank angle.

Line 151 in FIG. 6 represents the crankcase pressure profile for the first crankcase portion 21. Line 156 represents the crankcase pressure profile for the sixth crankcase portion 26. As can be seen, these two crankcase pressure profiles reach their maximum magnitudes at crankshaft angles that are only 60° apart as opposed to being 180° apart as described above in conjunction with the condition represented in FIG. 5. However, FIG. 6 shows that there is still a pressure differential which exists generally between crank angles of −45° and +75° of crankshaft angle. This pressure differential, although not as significant as that described above in conjunction with FIG. 5, is still sufficient to cause pumping action to occur through the conduits which connect the drain openings to the orifices. In other words, if conduit 111 in FIG. 4 is inappropriately connected between drain opening 101 and the orifice of the sixth crankcase portion, where check valve 136 is shown in FIG. 4, the decreased pressure differential between those two crankcase portions is still sufficient to cause oil to be pumped through conduit 111 to lubricate the cylinder of the sixth crankcase portion. In addition, if conduit 111 was inappropriately connected to the orifice of the second crankcase portion, a 60° crank angle between those two associated pistons would also provide a similar pressure differential that could be use to pump oil to the cylinder of the second crankcase portion. If, on the other hand, the drain openings 101–106 were not positioned as they are shown in FIG. 4, it would be possible to misconnect conduits in such a way that the significant pressure differentials described above in FIGS. 5 and 6 would not be available and the oil pumping action might not occur properly.

With reference to FIGS. 5 and 6, it should be understood that the pressure in the crankcase portions of the engine 10 is caused to increase as the piston 70 moves downward in its respective cylinder toward the crankshaft 78 to decrease the overall volume of air in the crankcase portion. At the same time that the piston 70 is being moved downwardly in the cylinder 72 by the crankshaft 78, the reed valves 32 are closing to prevent air from moving backward away from the engine and toward the air plenum 34. This decrease in volume raises the pressure in the crankcase portion. The opposite occurs as the piston is moved upwardly in the cylinder and away from the crankshaft 78.

With reference to FIGS. 2 and 4, it can be seen that, in its simplest form, the present invention provides a lubrication system for an engine in which a first piston is disposed within a first cylinder of the engine for reciprocation and the first crankcase portion 21 has a collecting region where residual oil can collect during operation of the engine. A drain opening 101 is formed through the housing of the crankcase portion and is in fluid communication with the collecting region which is directly below the primary oil entry point 91 shown in FIG. 4. A second piston is disposed in a second cylinder for reciprocation therein and the second cylinder has an orifice 124 formed through an internal cylindrical wall of the second cylinder which, in this example, is associated with the fourth crankcase portion 24. A conduit 111 is connected between the drain opening 101 and the orifice 124 to conduct the residual oil from the collecting region of the first crankcase portion 21 to the orifice 124. A check valve 134 is disposed in serial fluid communication with the conduit 111 to inhibit fluid flow in a direction from the orifice 124 back toward the drain opening 101.

The present invention solves two problems that can occur in an internal combustion engine. First, it removes residual oil from the crankcase and prevents the residual oil from accumulating to a magnitude which can be significantly deleterious to the operation of the engine. In addition, the present invention uses this residual oil as a lubricant for the cylinders of the engine. It is known that the residual oil can be burned in the combustion chambers of the cylinders, but the present invention does not merely dispose of the residual oil by burning it. Instead, the residual oil is put to a good use to lubricate the cylinder walls.

TABLE I

| Residual Oil Removed From Crankcase No. | Lubrication Provided to Cylinder No. |
|---|---|
| 1 | 4 |
| 2 | 5 |
| 3 | 6 |
| 4 | 1 |
| 5 | 2 |
| 6 | 3 |

In a particularly preferred embodiment of the present invention, as described above, the conduits 111–116 are connected to accomplish the interconnections described in Table I above. These interconnections maximize the pumping differential pressure in the associated crankcase portions. However, as described above, lesser pressures will also be sufficient as a result of the locations provided for the drain openings 101–106 and the fittings 141–146 shown in FIG. 4.

Although the present invention has been described with specific detail and illustrated to show one particularly preferred embodiment of the present invention, it should be understood that alternative embodiments are also within its scope.

We claim:

1. A lubrication system for an engine, comprising:

a first piston disposed within a first cylinder of said engine for reciprocating movement therein, said first piston being connected by a first connecting rod to a crankshaft of said engine, said first connecting rod being located within a first crankcase portion of said engine, said first crankcase portion having a collecting region where residual oil can collect during operation of said engine;

a drain opening formed through a housing of said first crankcase portion in fluid communication with said collecting region;

a second piston disposed within a second cylinder of said engine for reciprocating movement therein, said second piston being connected by a second connecting rod to said crankshaft of said engine, said second connecting rod being located within a second crankcase portion of said engine, said second cylinder having an orifice formed through an internal cylindrical wall of said second cylinder; and a conduit connected between said drain opening and said orifice to conduct said residual oil from said collecting region to said orifice.

2. The lubrication system of claim 1, further comprising:

a check valve disposed in serial fluid communication with said conduit to inhibit fluid flow in a direction from said orifice to said drain opening.

3. The lubrication system of claim 1, further comprising:

an oil inlet formed through said housing of said first crankcase portion; and an oil pump connected in fluid communication with said oil inlet to pump oil into said first crankcase portion through said oil inlet.

4. The lubrication system of claim 3, further comprising:

a reed valve assembly disposed within said first crankcase portion to permit air to flow into said first crankcase portion.

5. The lubrication system of claim 4, wherein:

said oil inlet is disposed directly above said drain opening within said first crankcase portion.

6. The lubrication system of claim 4, wherein:

said oil inlet is disposed at a location which is upstream of a fluid path to said drain opening along which oil tends to flow during certain normal modes of operation of said engine.

7. The lubrication system of claim 1, wherein:

said first and second pistons are 180 degrees out of phase with each other, wherein said first piston is at its top dead center position when said second piston is at its bottom dead center position.

8. The lubrication system of claim 1, wherein:

said orifice is formed through said internal cylindrical wall of said second cylinder at a position below piston rings of said second piston when said second piston is at its bottom dead center position.

9. The lubrication system of claim 1, wherein:

said drain opening and said orifice are on a common side of said engine.

10. The lubrication system of claim 1, wherein:

said engine is a six cylinder engine with said six cylinders being arranged in two rows of three cylinders each, said first and second cylinders being disposed in a common row with each other.

11. A lubrication system for an engine, comprising:

a first piston disposed within a first cylinder of said engine for reciprocating movement therein, said first piston being connected by a first connecting rod to a crankshaft of said engine, said first connecting rod being located within a first crankcase portion of said engine, said first crankcase portion having a collecting region where residual oil can collect during operation of said engine;

a drain opening formed through a housing of said first crankcase portion in fluid communication with said collecting region;

a second piston disposed within a second cylinder of said engine for reciprocating movement therein, said second piston being connected by a second connecting rod to said crankshaft of said engine, said second connecting rod being located within a second crankcase portion of said engine, said second cylinder having an orifice formed through an internal cylindrical wall of said second cylinder;

a conduit connected between said drain opening and said orifice to conduct said residual oil from said collecting region to said orifice;

a check valve disposed in serial fluid communication with said conduit to inhibit fluid flow in a direction from said orifice to said drain opening;

an oil inlet formed through said housing of said first crankcase portion; and an oil pump connected in fluid communication with said oil inlet to pump oil into said first crankcase portion through said oil inlet.

12. The lubrication system of claim 11, further comprising:

a reed valve assembly disposed within said first crankcase portion to permit air to flow into said first crankcase portion.

13. The lubrication system of claim 1, wherein:

said oil inlet is disposed at a location which is upstream of a fluid path to said drain opening along which oil tends to flow during certain normal modes of operation of said engine.

14. The lubrication system of claim 13, wherein:

said oil inlet is disposed directly above said drain opening within said first crankcase portion.

15. The lubrication system of claim 11, wherein:

said first and second pistons are 180 degrees out of phase with each other, wherein said first piston is at its top dead center position when said second piston is at its bottom dead center position.

16. The lubrication system of claim 11, wherein:

said orifice is formed through said internal cylindrical wall of said second cylinder at a position below piston rings of said second piston when said second piston is at its bottom dead center position.

17. The lubrication system of claim 11, wherein:

said drain opening and said orifice are on a common side of said engine.

18. The lubrication system of claim 17, wherein:

said engine is a six cylinder engine with said six cylinders being arranged in two rows of three cylinders each, said first and second cylinders being disposed in a common row with each other.

19. A lubrication system for an engine, comprising:

a first piston disposed within a first cylinder of said engine for reciprocating movement therein, said first piston being connected by a first connecting rod to a crankshaft of said engine, said first connecting rod being located within a first crankcase portion of said engine, said first crankcase portion having a collecting region where residual oil can collect during operation of said engine;

a drain opening formed through a housing of said first crankcase portion in fluid communication with said collecting region;

a second piston disposed within a second cylinder of said engine for reciprocating movement therein, said second piston being connected by a second connecting rod to said crankshaft of said engine, said second connecting rod being located within a second crankcase portion of said engine, said second cylinder having an orifice formed through an internal cylindrical wall of said second cylinder;

a conduit connected between said drain opening and said orifice to conduct said residual oil from said collecting region to said orifice;

a check valve disposed in serial fluid communication with said conduit to inhibit fluid flow in a direction from said orifice to said drain opening;

an oil inlet formed through said housing of said first crankcase portion;

an oil pump connected in fluid communication with said oil inlet to pump oil into said first crankcase portion through said oil inlet; and a reed valve assembly disposed within said first crankcase portion to permit air to flow into said first crankcase portion, said oil inlet being disposed at a location which is upstream of a fluid path to said drain opening along which oil tends to flow during certain normal modes of operation of said engine.

20. The lubrication system of claim 19, wherein:

said first and second pistons are 180 degrees out of phase with each other, wherein said first piston is at its top dead center position when said second piston is at its bottom dead center position, said orifice being formed through said internal cylindrical wall of said second cylinder at a position below piston rings of said second piston when said second piston is at its bottom dead center position, said drain opening and said orifice being on a common side of said engine.

* * * * *